US005117403A

United States Patent [19]

Eberl et al.

[11] Patent Number: 5,117,403

[45] Date of Patent: May 26, 1992

[54] ABOVE AND BELOW WATER SOUND TRANSDUCER

[76] Inventors: Adolf Eberl; Rolf Eberl, both of 214 Bruce Ave., Kincardine, Ontario N2Z 2P, Canada

[21] Appl. No.: 710,758

[22] Filed: May 31, 1991

[51] Int. Cl.[5] ..... H04R 9/00

[52] U.S. Cl. ..... 367/175; 367/182; 367/185

[58] Field of Search ..... 367/175, 182, 185, 141; 381/192, 199, 200, 201

[56] References Cited

U.S. PATENT DOCUMENTS

| | | | |
|---|---|---|---|
| 1,507,171 | 9/1924 | Hahnemann et al. | 367/175 |
| 1,604,693 | 10/1926 | Hecht et al. | 367/175 |
| 1,640,538 | 8/1927 | Du-Bois-Reymond | 367/175 |
| 4,384,351 | 5/1983 | Pagliarini, Jr. et al. | 367/175 |

*Primary Examiner*—J. Woodrow Eldred
*Attorney, Agent, or Firm*—Richard L. Miller

[57] ABSTRACT

A noise cancelling watertight transducer that converts sound wave to electromagnetic waves or conversely electromagnetic waves to sound waves comprises a hollow shell having curved walls mounted for movement in a resilient container. A freely movable inertial mass is located inside said shell. The inertial mass resists movement when a force is applied thereto. Signal translating means are incorporated therein consisting of either an electromagnetic device, a piezoelectric element or voltage potential senative element that is mounted in and connected with said shell and interacts with said inertial element. In response to appropriate signal some embodiments of the instant invention acts as a bidirectional device converting electrical signal to acoustical signal or conversely acoustical signal to electrical signal.

11 Claims, 2 Drawing Sheets

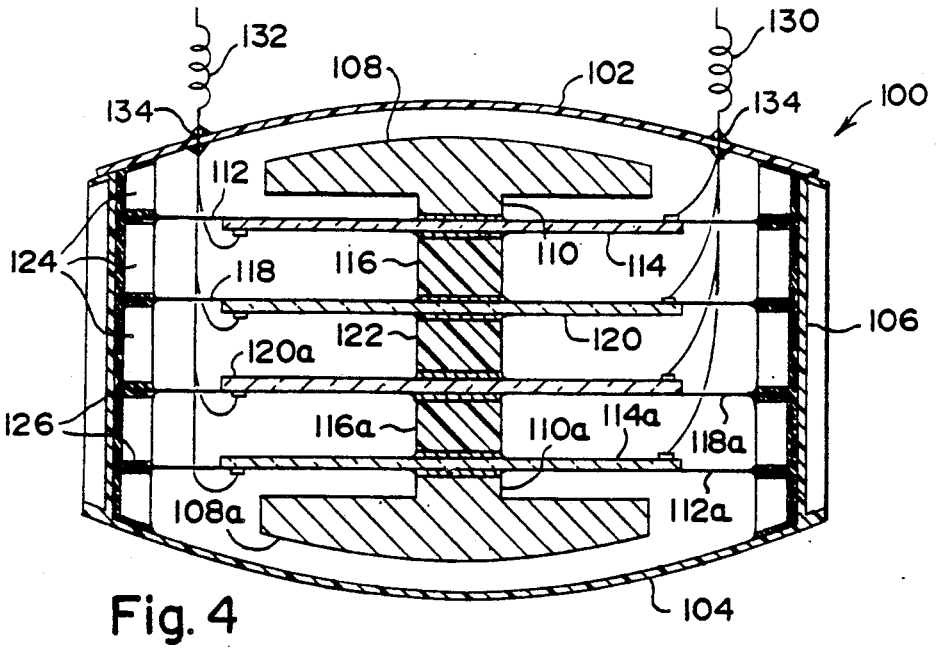
Fig. 4
Fig. 5
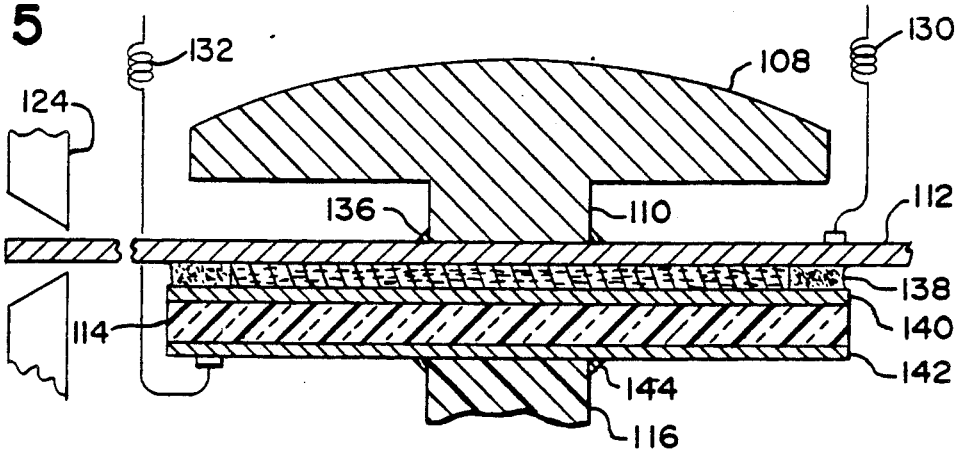
Fig. 6
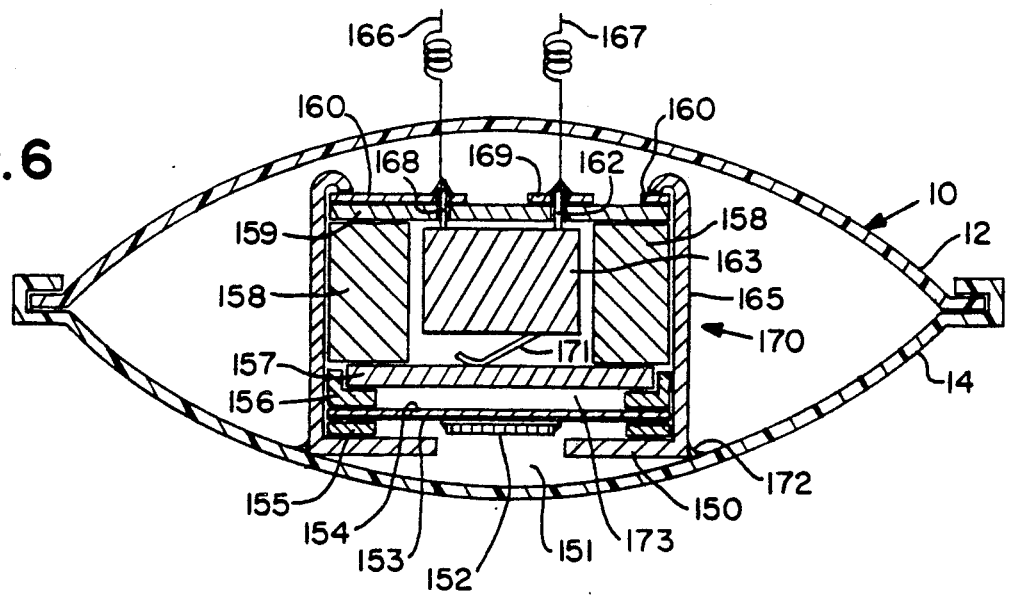

ABOVE AND BELOW WATER SOUND TRANSDUCER

BACKGROUND OF THE INVENTION

1. Field of Invention

This invention relates to a noise cancelling watertight sound transducer which is useful as a microphone or earphone. A hollow shell contains an inertial mass and an output signal is produced when the shell vibrates relative to the mass either as a result of external sound waves striking the shell, or as a result of a magnetic or piezoelectric actuator within the enclosure attempting to move the mass and thereby causing the shell to vibrate.

2. Description of the Prior Art

Acoustic transducers useful in underwater applications are known in the art. Few of such transducers, however, cancel noise such that random external pressure variations do not appear in the output as noise. Further, even fewer are small enough or sufficiently portable to be useful as an earphone or microphone for underwater applications such as by a scuba driver.

U.S. Pat. No. 4,797,863 to Gonzalez et al describes and underwater transducer with an annular, spring steel band supporting a fabric diaphragm. A flexible piezoelectric cable transducer is attached adjacent the band. Acoustical disturbances cause vibrations of the diaphragm deforming the cable to produce an electrical output signal. The present invention is less costly, simpler, lighter and less cumbersome than this prior art device.

U.S. Pat. No. 4,763,307 to Massa describes a sealed underwater acoustic transducer with a massive vibratory member in contact with the water actuable in response to a power supply to produce oscillatory vibrations in the water. This device is heavy and complex, and is not useful as a portable microphone or earpiece.

A more useful device is shown in U.S. Pat. No. 3,764,966 to Abbagnaro which comprises an underwater earphone assembly with a cylindrical casing sealed on both sides, one having a vibratory diaphragm and the other side a flexible rubber diaphragm. Electromagnetic energizing coils inside the casing cause the vibratory diaphragm to move. The device is filled with oil which damps the response of the device and also reduces its efficiency. The device's primary problem is that the vibratory diaphragm is clamped to the casing around its periphery and its greatest deflection is at its center, which creates distortions in the output.

The present invention is substantially simpler, lighter and less complex and expensive than the prior art, and is specifically adapted for use in underwater applications such as an earpiece or throat microphone for persons such as scuba peronnel. The benefits of the device are produced primarily by its use of a rigid hollow shell, the shell being able to withstand water pressure of 300 feet or more. An inertial mass is located inside the hollow shell and mounted such that it can move freely along a predetermined axis. When used as a microphone, the shell vibrates in response to the acoustic pressure due to the voice input, and because the inertial mass attempts to remain in its original position an electromagnet or piezoelectric element inside the shell will produce an audio frequency output signal. In this application the shell may be mounted by a suspension such as foam in a casing open to sound vibrations front and back. When used as an earphone, the electromagnet or piezoelectric element attempts to move the inertial mass, but because it resists movement the force is translated to by the shell which vibrates at the audio frequency.

SUMMARY OF THE INVENTION

It is therefore an object of this invention to provide a sound transducer which is simple, light, inexpensive, rugged and sufficiently small to be useful both as a microphone and an earpiece.

Another object of this invention is to provide a sound transducer construction which is useful in a variety of fluids such as the atmosphere and underwater. A further object of this invention is a sound transducer having a hollow, watertight outer shell in which is located an inertial mass which resists movement such that the shell will move relative to the mass upon application of an internal or external force.

A still further object of this invention is an underwater sound transducer which is efficient at cancelling noise.

In accordance with a preferred embodiment of this invention there is described a noise cancelling and watertight sound transducer which has an outer rigid shell with substantially identical curved front and back faces joined by a sidewall, the shell being circular in plan view. The faces respond equally to ambient pressure. Located within the hollow shell is an inertial mass which is free to move a short distance back and forth in the direction of said curved faces. Also within the shell is an electromagnetic, piezoelectric or electret element which interacts with the inertial mass. In response to an audio signal, i.e. a mechanical wave in a fluid, the hollow shell, which is affixed in a resilient container, vibrates because of the inertia of the mass which resists movement. The transducer may be used as a microphone in which the speech creates a pressure on the shell, or as an earphone in which a modulated electromagnetic signal attempts to move the inertial mass within the shell.

BRIEF DESCRIPTION OF THE DRAWINGS

FIG. 4 is a diagrammatic cross sectional view of a fourth embodiment of this invention utilizing a plurality of piezoelectric ceramic elements; and FIG. 5 is an enlarged cross sectional view showing in greater detail the construction illustrated in FIG. 4.

FIG. 6 is a diagrammatic cross sectional view of a fifth embodiment of this invention using a modified electret element.

DESCRIPTION OF THE PREFERRED EMBODIMENT

Figure 1:
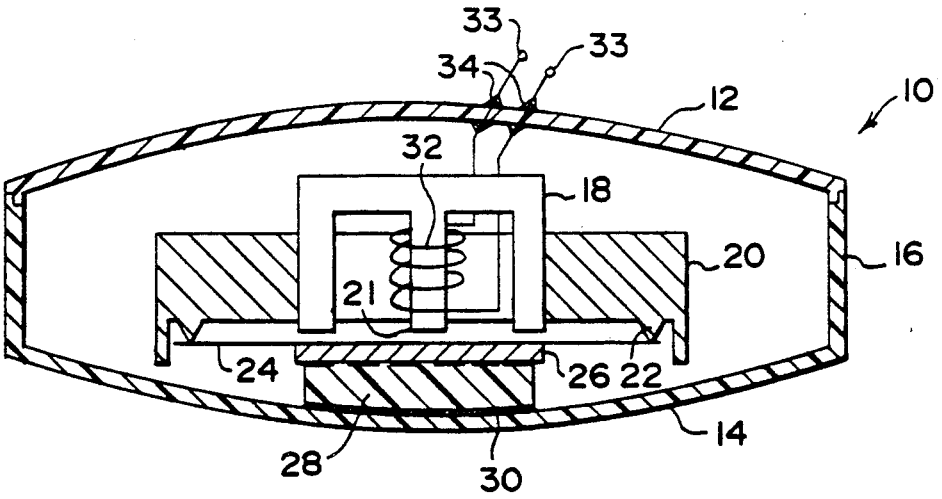
FIG. 1 is a diagrammatic cross sectional view of a first embodiment using an electromagnetic element.
Figure 2:
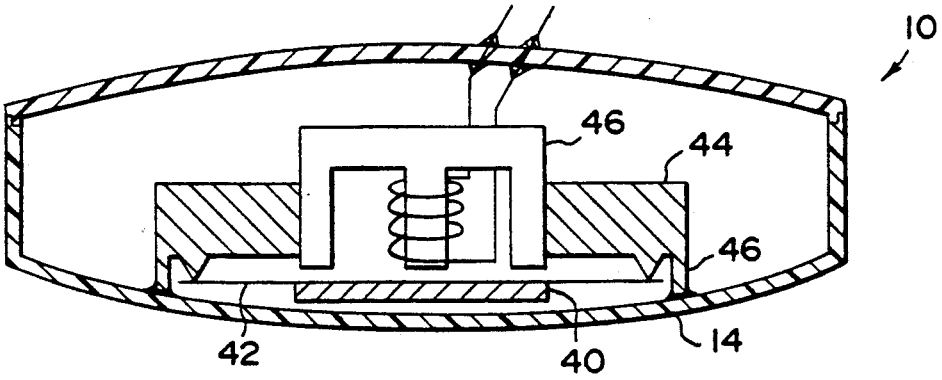
FIG. 2 is a diagrammatic cross sectional view of a second embodiment using an electromagnetic element.
Figure 3:
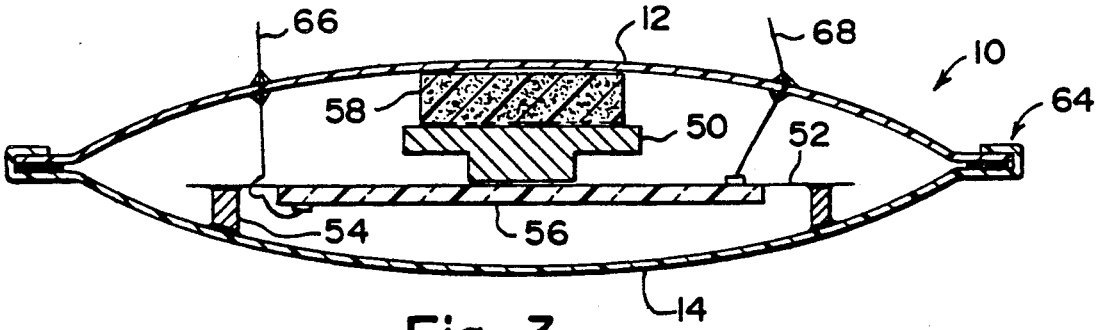
FIG. 3 is a diagrammatic cross sectional view of a third embodiment of this invention utilizing a piezoelectric ceramic element.

FIGS. 2 and 3 shows embodiments of the instant invention better suited to be used as a microphone, while FIGS. 1 and 4 shows embodiments of the instant invention better suited to be used as an earphone. Each embodiment relies on the inertia of a mass freely mounted within a hollow shell which may in turn be affixed for movement within a container. When used as a microphone, sound waves move the shell relative to the mass and the mass alters the output from an electromagnet or piezoelectric element. When used as an earphone, the electromagnet or piezoelectric element attempts to move the mass which causes vibration of the shell at an audio frequency.

The microphone embodiments have excellent noise cancelling qualities. Prior to this invention it was difficult to attain equal pressure on the front and back of a microphone diaphragm, especially in dynamic and magnetic units, because the magnets are in the way. This invention overcomes these limitations by making the diaphragm hollow and placing the movement inside of the hollow diaphragm. By this expedient the pressure on the outside of the shell is better equalized. Since the shell is also made water proof and is contoured to withstand high water pressure, the device becomes an excellent microphone useful in a scuba mask, or as a contact or throat microphone in numerous bad weather applications.

Referring to FIG. 1 a shell 10 of rigid material such as plastic or aluminum has a slightly curved top surface 12 and bottom surface 14 with a sidewall 16 therebetween. In plan view the shell 10 is circular. The movable inertial mass comprises a magnetized core 18 having a central pole piece 21 surrounded by a non-magnetic heavy support body 20 of a material such as bass. Body 20 has a peaked spacing ring 22 near its outer periphery. The peak of 22 sits on a thin steel membrane 24 bonded to a washer or soft iron disk 26, which is in turn bonded to a plastic spacer 28. Spacer 28 is bonded to the inside of bottom surface 14, the bonding shown at 30. An electrical wire 32 is coiled about center pole piece 21, the ends of the wire 33 extending through the shell 10 via water-tight and insulating seals 34. An AC voltage source (not shown) is connected to wire ends 33 producing a mechanical movement proportional to the electrical signal as is well known in the art.

In FIGS. 2 and 3 the shell 10 is located within a container, not shown, with a foam substance or the like between the shell and the container such that the shell is free to vibrate. The container may be mounted on a boom.

In the embodiment of FIG. 1 the inertial mass takes the form of the magnet, winding and body assembly which attempts to remain stationary as the shell 10 vibrates within its container because of the electrical audio signal applied to the coil 32. Shell 10 will thus vibrate at the appropriate audio frequencies, and disk 26 will move relative to the electromagnet. While this embodiment is very efficient, it is most responsive to lower frequencies and is less desirable in throat microphone applications but is superbly suited as an earphone or bone conducting transducer.

In FIG. 2 the shell 10 is similar to that of FIG. 1, but the soft iron disk 40 bonded to steel membrane 42 is free to move and operates as the inertial mass. The movement body 44 surrounding the magnetized core 46 is bonded to the inside of the bottom surface 14 via an outer flange 46 connected or integral with the movement body 44. Operation is similar to the device of FIG. 1 but is less efficient although more responsive at higher audio frequencies, giving better tone quality. It is preferred as a throat microphone or noise cancelling microphone when mounted on the end of a boom.

FIG. 3 uses a lead weight 50 bonded to a thin metal membrane 52 which is in turn bonded to a plastic spacer ring 54. The spacer ring 54 is bonded to the inside of bottom surface 14. A piezoelectric element 56 is bonded to metal membrane 52. A foam plastic damping pad 58 is located between lead weight 50 and top surface 12.

The top and bottom surfaces 12 and 14 are joined at their edges to form a waterproof seal as shown at 64. Electrical leads 66 and 68 are attached to opposite sides of piezoelectric element 56. Vibration of the shell 10 attempts to move weight 50 in response thereto, and as the shell vibrates the inertia of weight 50 produces a bending moment in piezoelectric element 56. An electrical signal is thereby generated and is fed out by leads 66 and 68 at the audio frequency of the voice signal. This embodiment produces good voice frequency reproduction with a high output impedance and good noise rejection.

The embodiment in FIG. 6 shows a noise cancelling or underwater microphone with an electret microphone 170 as its vibration converting element. The function and composition of the electret microphone is as follows.

The housing 165 is a thin walled aluminum cylinder typically about ¼" diameter and about ¼" high closed on one side by a wall 150, with a hole 151 in the center. Stacked inside in contact with the housing is metal ring and spacer 155, next in contact is a thin electret membrane 154 which acts as the first electrode with its silver vacuum deposited coating 153 in contact and grounded through spacer 155. Plastic spacer and centering ring 156 hold in place flat metal disc 157 acting as the second electrode. Plastic filler and spacer 158 compresses the forementioned stack and also holds the Field Effect Transistor (F.E.T.) 163 amplifier in place and in contact with metal disc 157 with its spring 171 internally connected to the gate of the F.E.T. amplifier. The stack is closed on the top by a round printed circuit (P.C.) wafer 159 with two holes and two copper lands etched out of the copper laminate. One land, 160 is ring shaped and encircles the outer edge of the P.C. wafer and also connects to the Negative wire 166 as well as to the Source contact 168 of the F.E.T., the housing and ground. The second copper land 169 connects the Positive wire 167 and the Drain contact 162 of the F.E.T. to the load resistor in the external circuit (not shown). To convert this regular electret microphone to an inertia or contact microphone a small round disc shaped weight 152 is bonded to the center of the silvered surface of the electret membrane. The electret microphone is glued 172 to the inside center of the lower half 14 of the shell 10 which is crimped water-tight to the upper half 12 of the shell 10. Insulated wires 166 and 167 go through upper shell 12 and are made water-tight with adhesive.

If shell 10 vibrates in response to sound vibration from the air, water or from contact with solid matter, weight 152 tries to remain stationary and changes the air gap 173 between the first electrode 154 and the second electrode 157 changing the electric potential of the so composed condenser. The electret membrane is manufactured from a special plastic which has imprinted in its molecular structure a potential equivalent to 100 VDC. This voltage is normally used in condenser microphones to make the fluctuating potential between the electrodes more effective with changes in the air gap. The change in potential manifests itself as a change in the voltage on the second electrode which is then amplified by the F.E.T. amplifier resulting in an electrical signal proportional to the sound vibrations applied to the outer shell 10. This embodiment of FIG. 6 has the highest output of all systems as well as a very good frequency response.

With respect to the use of the invention as a microphone, both sides of the shell are exposed to equal sound pressures except when a sound source is located very close, in which case the sound pressure generated on one side of the shell by the source is much stronger causing the shell to move and an audio frequency modulated output signal to be produced by the magnetic or piezoelectric assembly.

Boom mounted microphones incorporating the teachings of FIGS. 2 and 3 are useful in extreme weather situations by fire departments, police, military, shipboard and airport personnel and other applications. All embodiments operate up to and beyond 120dba. Intelligebility is excellent.

FIG. 4 shows an underwater earphone or bone conducing transducer comprising a hollow metal or plastic shell 100 with a curved top surface 102, a curved bottom surface 104 and a plastic outer wall 106. The hollow body is waterproof and will withstand pressures at 300 feet below the surface.

The inertial mass within shell 100 comprises identical lead weights 108 and 108a each narrowed at the neck 110, 110*a* and bonded to a metal membrane 112, 112*a*. Pieroelectric ceramic elements 114, 114*a* are bonded to the other side of metal membranes 112, 112*a* with conductive adhesive. Bonded to the other side of the piezoelectric ceramic elements 114, 114*a* are plastic spacers 116, 116*a* with additional similar combinations of metal membrane 118, 118*a* and piezoelectric ceramic elements 120, 120*a* with a central plastic spacer 122.

Each metal membrane 112, 112*a*, 118, 118*a* is bonded between a pair of circular plastic ring spacers 124. The bonding is shown at 126 between the ring spacers 124 and shell 106, and serves to electrically isolate the inner components from the shell 100.

Connected to one side of each piezoelectric ceramic element 114, 114*a*, 120, 120*a* is a wire 130 and connected to the other side is a second wire 132, both wires passing through waterproof seals 134. An audio frequency electrical input power source is connected to wires 130,132.

FIG. 5 shows the details of the bonding of the elements in FIG. 4. Lead weight 108 is attached to metal membrane 112 by an epoxy 136, with a conductive bonding and epoxy layer 138 and metal plating layer 140 located between metal membrane 112 and peizoelectric ceramic element 114. Another layer of metal plating 142 is located between piezoelectric ceramic element 114 and plastic spacer 116. The spacer 116 is bonded by epoxy 144 to the metal plating 142.

FIG. 4 wires 130, 132 are bonded or soldered to metal plating layer 142 and metal membrane 112 so that the piezoelectric ceramic elements are electrically wired in parallel.

When an audio frequency input signal is applied to the earphone of FIG. 4 via lines 130 and 132, all peizoelectric ceramic elements will bend simultaneously. Because of the inertia of the lead weights 108, 108*a* the shell 100 will vibrate at the audio frequency and reproduce the audio wave as a pressure wave in identical fashion to a loud speaker. This device needs to be driven by a voltage of 4 to 5 volts rms, and has good tone reproduction with low power consumption. The structure can be constructed as small as $\frac{7}{8}''$ in diameter and $\frac{3}{8}''$ high, and can easily be accommodated under wetsuits or in masks or other headgear.

The earphones of FIGS. 1 and 4 use far fewer parts than prior art devices, and assembly is less critical and accomplished with adhesives or an ultrasonic welder.

While this invention has been described with respect to a preferred embodiment thereof, it is apparent that changes may be made in the construction and arrangement of its components without departing from the scope of the invention as hereinafter claimed.

What is claimed is:

1. A sound transducer comprising:

(a) a symmetrical waterproof outer shell of rigid nonmagnetic material a hemispherical front wall and a hemispherical back wall directly opposite said front wall with both said walls being joined to form a sidewall therebetween, both of said front and back walls being slightly concave with respect to the center of said shell;

b) an inertial member having substantial mass located within said shell, said member extending parallel to an axis contiguous with the center of said sidewall, said member having a length along said axis substantially greater than its width perpendicular to said axis, said member being mounted inside said shell such that it is free to move a short distance within said shell back and forth along a line perpendicular to said axis, in which said inertial member comprises a disk of magnetic metal bonded on one side to a thin metallic membrane extending beyond the end of said disk, said disk and said membrane being parallel to said axis, and said signal translating means comprises an electromagnet assembly having a central pole piece of soft iron material surrounded by a permanent magnet and having an electrical winding about said central pole piece, said assembly being secured to the inside of one of said walls with said inertial member being located between said assembly and an inside surface of said shell, said electrical winding extending through said shell to the outside thereof; and c) signal translating means within said shell adjacent to an interacting with said inertial member and responsive to relative movement between said inertial member and said shell for converting an acoustic wave signal of one wave type to an acoustic wave signal of another wave type.

2. A sound transducer as in claim 1 in which said signal translating means converts a fluid mechanical sound wave into an electromagnetic wave.

3. A sound transducer as in claim 1 in which said signal translating means converts a electromagnetic wave into a fluid mechanical wave.

4. A sound transducer as in claim 1 in which said inertial member is centrally mounted in said shell relative to a line between the center of said front and back walls.

5. A sound transducer comprising (a) a symmetrical waterproof outer shell of rigid nonmagnetic material a hemispherical front wall and a hemispherical back wall directly opposite said front wall with both said walls being joined to form a sidewall therebetween, both of said front and back walls being slightly concave with respect to the center of said shell;

(b) an inertial member having substantial mass located within said shell, said member extending parallel to an axis contiguous with the center of said sidewall, said member having a length along said axis substantially greater than its width perpendicular to said axis, said member being mounted inside said shell such that it is free to move a short distance within said shell back and forth along a line perpendicular to said axis, in which said inertial member and said signal translating means are integrally interconnected and comprise a movement body electromagnet assembly having a central pole piece of soft iron material surrounded by a permanent magnet, said movement body being freely mounted on a seat comprising a thin steel membrane to which is bonded a disk of magnetic metal, the other side of said disk being bonded to a plastic spacer member which is in turn bonded to an inside surface of said shell, and an electrical winding about said central pole piece and extending through said shell to the outside thereof; and (c) signal translating means within said shell adjacent to and interacting with said inertial member and responsive to relative movement between said inertial member and said shell for converting an acoustic wave signal of one wave type to an acoustic wave signal of another wave type.

6. A sound transducer as in claim 5 in which said signal translating means converts a fluid mechanical sound wave into an electromagetic wave.

7. A sound transducer as in claim 5 in which said signal translating means converts a electromagnetic wave into a fluid mechanical wave.

8. A sound transducer as in claim 5 in which said inertial member is centrally mounted in said shell relative to a line between the center of said front and back walls.

9. A sound transducer comprising:

(a) a substantially symmetrical outer shell of rigid nonmagnetic material;

(b) an inertial member having substantial mass located within said shell, in which said inertial member comprises a disk of magnetic metal bonded on one side to a thin metallic membrane extending beyond the end of said disk, and said signal translating means comprises an electromagnet assembly having a central pole piece of soft iron material surrounded by a permanent magnet and having an electrical winding about said central pole piece, said assembly being secured inside said outer shell of rigid nonmagnetic material and in close proximity to said inertial member having substantial mass; and (c) signal translating means within said shell adjacent to said interacting with said inertial member and responsive to relative movement between said inertial member and said shell for converting an acoustic wave signal of one wave type to an acoustic wave signal of another wave type.

10. A sound transducer as in claim 9 in which said signal translating means converts a fluid mechanical sound wave into an electromagnetic wave.

11. A sound transducer as in claim 9 in which said signal translating means converts an electromagnetic wave into a fluid mechanical wave.

* * * * *